US005581977A

United States Patent [19]

Johnson

[11] Patent Number: 5,581,977

[45] Date of Patent: Dec. 10, 1996

[54] METHOD FOR HANDLING AND PRINTING PAPERBOARD TRAYS IN A PACKAGING MACHINE

[75] Inventor: Lloyd Johnson, Portland, Conn.

[73] Assignee: Standard-Knapp, Inc., Portland, Conn.

[21] Appl. No.: 337,628

[22] Filed: Nov. 10, 1994

[51] Int. Cl.[6] ..... B65B 41/00

[52] U.S. Cl. ..... 53/411; 53/131.4; 53/397; 53/389.1; 53/534

[58] Field of Search ..... 271/10, 34, 35, 271/3.01, 3.03, 3.05, 10.06; 493/320, 323; 53/397, 398, 411, 448, 131.4, 534, 389.1

[56] References Cited

U.S. PATENT DOCUMENTS

| | | | |
|---|---|---|---|
| 2,720,162 | 10/1955 | Currivan et al. | 493/53 |
| 3,612,511 | 10/1971 | Godlewski | 271/3.05 |
| 3,619,966 | 11/1971 | Goldsberry | 53/411 |
| 3,776,544 | 12/1973 | Watson et al. | 271/3.03 |
| 3,777,445 | 12/1973 | Anderson | 53/411 |
| 4,363,478 | 12/1982 | Tsukasaki | 271/10 |
| 4,631,895 | 12/1986 | Ghiretti et al. | 53/534 |
| 4,642,967 | 2/1987 | Culpepper | 53/398 |
| 5,000,088 | 3/1991 | Cargill | 271/35 |

*Primary Examiner*—John Sipos
*Assistant Examiner*—Ed Tolan
*Attorney, Agent, or Firm*—McCormick, Paulding & Huber

[57] ABSTRACT

A paperboard tray packaging machine is adapted to handle the tray blanks and product to be packaged as both move continually in a downstream direction. The blanks are stored in an auxiliary magazine alongside the main magazine and are transferred from one to the other individually so each tray blank can be printed, at least on the blank end walls that cannot be conveniently printed in the machine itself.

2 Claims, 3 Drawing Sheets

METHOD FOR HANDLING AND PRINTING PAPERBOARD TRAYS IN A PACKAGING MACHINE

BACKGROUND OF THE INVENTION

This invention relates generally to packaging machines, and deals more particularly with a method for storing a plurality of tray blanks above the path defined by the packaging machine for these blanks as they move downstream through a load station where they are mated with product groups prior to folding of the tray blank side and end walls. More specifically, the invention relates to a method of handling the paperboard tray blanks wherein the blanks are stored in a first tray load station and stripped successively therefrom to pass across a fixed printing head or heads that provide a suitable label on the end walls of the blank prior to the blank being deposited in a second load station. The blanks are then stripped from the second load station for entry into the packaging machine itself. The packaging machine mates the tray blanks with product at a load station after which the end and side walls of the tray blank may be folded prior to a conventional compression section and/or a shrink film overwrap. As a result of the direction of movement for the tray blanks through the packaging machine conventional printing techniques can be utilized for labeling the side walls of the tray.

DESCRIPTION OF THE PRIOR ART

Conventional practice in connection with printing of tray blanks may take the form of preprinting the blanks prior to utilization in a packaging machine. However, where unprinted tray blanks are to be utilized in a packaging machine the packer has been limited to printing only on one and an opposite side wall of the tray as a result of the present day continuous in-line motion of packaging machines that move the tray blank downstream generally in a single direction through the load station, compression station, and shrink film tunnel.

SUMMARY OF THE INVENTION

The general purpose and object of the present invention is to provide a method for handling the tray blanks in the tray blank loading section of the packaging machine so that the end walls of the tray blank can be printed prior to being conveyed downstream in the direction defined by the packaging machine.

In accordance with the method of the present invention paperboard tray blanks are stored in a first load station provided alongside the path of the blanks through the packaging machine. The lowermost blank in this first load station is stripped from the stack in the magazine for movement in a direction generally perpendicular to the downstream direction defined by the packaging machine. A stationary printer or printers are provided in the paths of the tray blank as it is propelled from this first load station so that the end walls of the tray blank can be printed on during such movement. The tray blanks are received by a second blank load station located immediately above the path taken by the tray blanks as they move downstream in the packaging machine itself. Thus, the printed tray blanks can then be stripped from the second load station for movement in this downstream direction.

BRIEF DESCRIPTION OF THE DRAWINGS

A more complete understanding of the invention and many of its attendant advantages will be appreciated as the same become better understood by reference to the following detailed description when considered in conjunction with the accompanying drawings wherein.

DETAILED DESCRIPTION OF THE PREFERRED EMBODIMENT (FIGS. 1–4)

Figure 2:
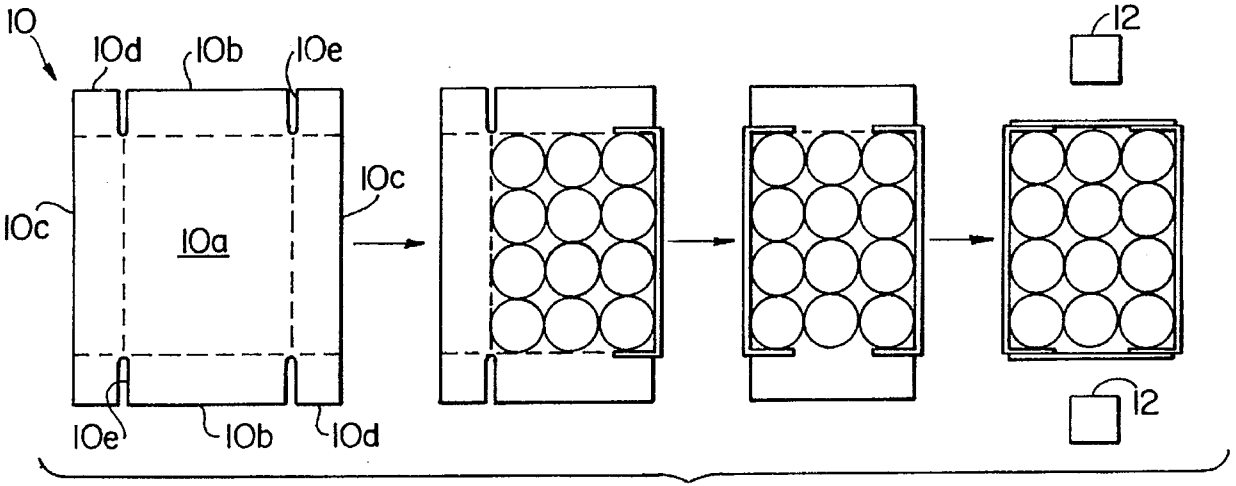
FIG. 2 illustrates in a sequence of views the tray blank as it is folded around the product downstream of the load station, and also illustrates the conventional locations for printing heads that are capable of printing on the opposed side walls of the tray usually after the tray has been folded around the product group.

Referring initially to FIG. 2, a typical tray blank is indicated generally at 10, such tray blank having a bottom panel 10*a*, and side walls 10*b* connected thereto along prescored fold lines. These leading and trailing end walls of the tray 10 also include corner tabs 10*d* that are integrally connected to the end walls 10*c* along fold lines, but which are separated from the side walls 10*b* by notched portions 10*e* of the blank.

Still with reference to FIG. 2, the succeeding views illustrate the configuration for the blank after a product group has been mated with it so that the product, or articles rest on the bottom panel 10*a* and form a suitable mandrel for folding of the side and end wall flaps as shown. It will be apparent that conventional dot matrix printers 12, 12 can be provided in the fixed frame of the machine for printing on the side flaps of the folded tray blank as shown in FIG. 2.

Figure 1:
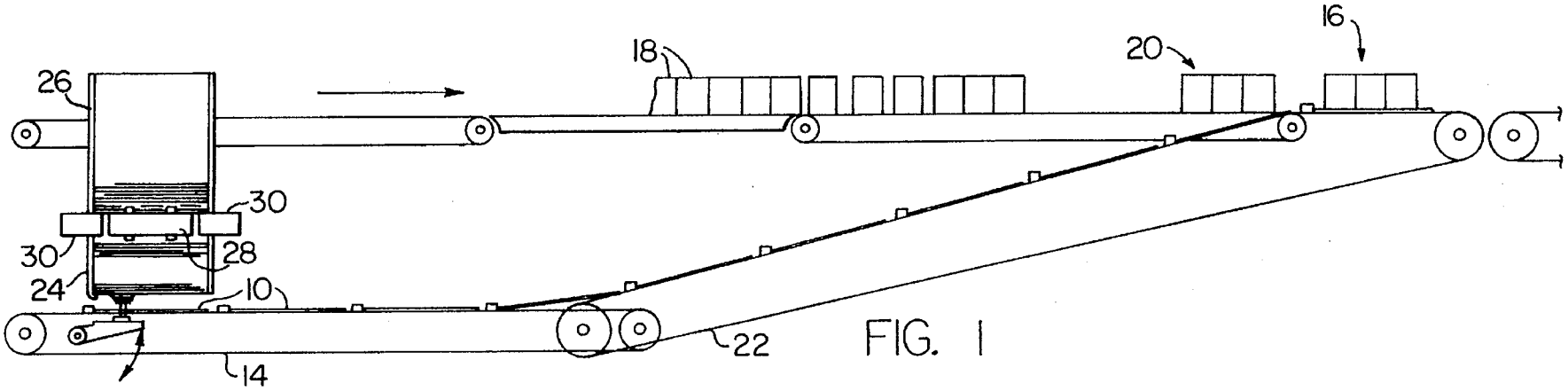
FIG. 1 shows in a schematic fashion, and in elevation, the relevant portion of a typical packaging machine capable of handling tray blanks delivered from a magazine with printing capability according to the invention and feeding them downstream toward a load station where the trays are mated with product groups that also move continually downstream in the same general direction.

As best shown in FIG. 1, the flat tray blanks are generally stored in a magazine 24 where the lowermost tray blank can be withdrawn from the bottom of the magazine for deposit on a conveyor 14 that carries the tray blank downstream toward the load station. FIG. 1 illustrates the load station generally at 16, and this view also illustrates the path taken by the product 18 as the product is conveyed through a grouper section illustrated schematically at 20 for timed deposit on the bottom panel of each tray blank moved through the load station by conveyor 22.

Figure 3:
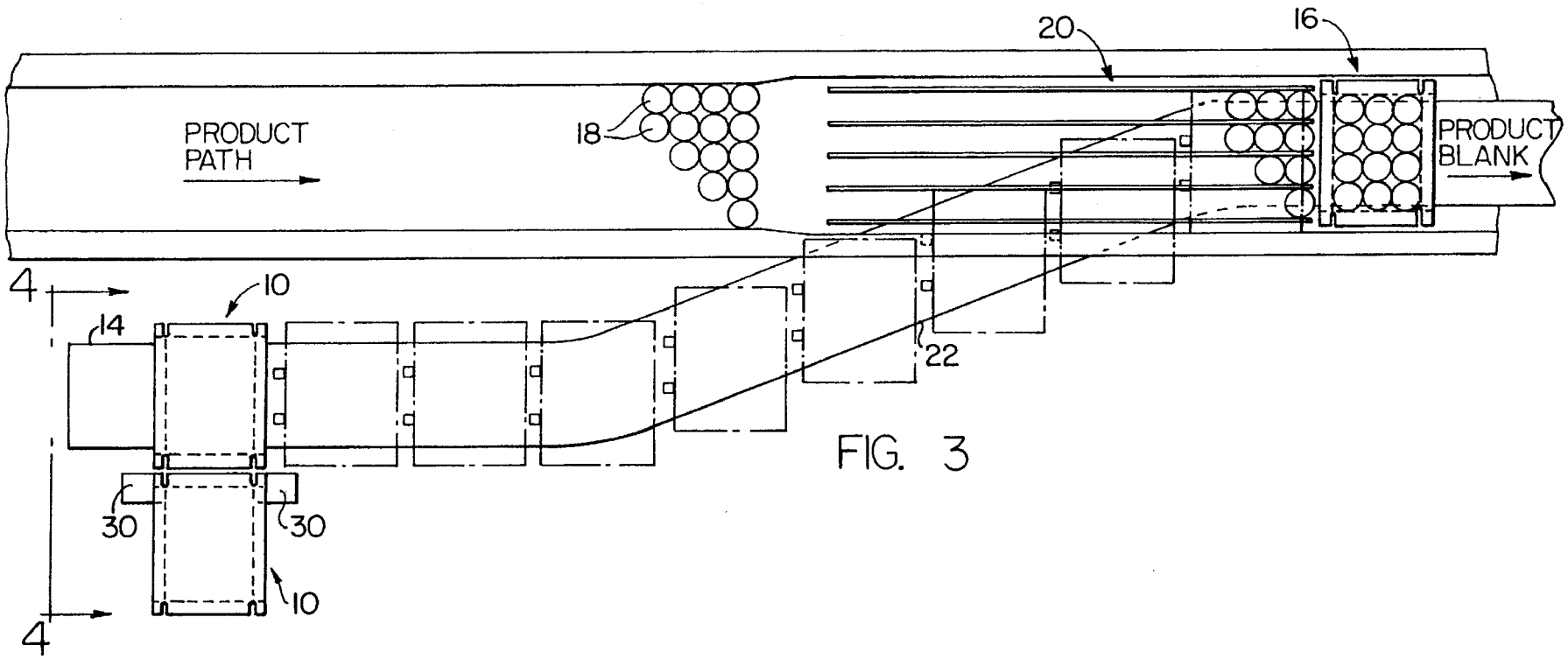
FIG. 3 is a plan view illustrating in schematic fashion the relevant portion of the packaging machine of FIG. 1 equipped with magazines and associated printing devices of the present invention.
Figure 4:
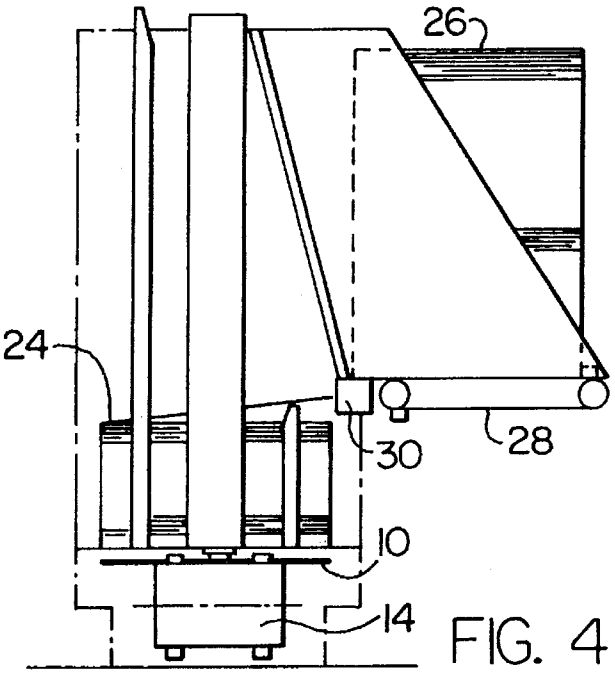
FIG. 4 is an end view taken generally on the line 4—4 of FIG. 3 illustrating the magazines of the present invention provided in association with printing devices and the conveyor for the tray blanks that comprises a part of the packaging machine.

Referring now to FIGS. 3 and 4, the conveyor 14 for the tray blanks is provided immediately below a magazine 24 mounted immediately above the conveyor 14 for this purpose. In accordance with the present invention this magazine 24 is not filled with tray blanks, but is instead supplied with tray blanks successively from another magazine 26 mounted to the magazine 24 or otherwise provided in association with the magazine 24 so as to afford a receptacle for the unprinted tray blanks that are to be used for forming a package of predetermined product type.

Thus, the magazine 26 comprises a first magazine for storing unprinted blanks and includes a suitable means 28 for stripping the lowermost blank in the stack provided in the first magazine 26 and moving it in the direction of the second magazine 24 upon which it is mounted. The means 28 comprises a short conveyor system is provided for intermittent operation to sequentially strip the lowermost blank in the stack of blanks provided in the first magazine 26. A pair of printheads 30, 30 are provided in the path of travel of the blank as it moves from the first magazine 26 into the second magazine 24 to afford a convenient location for printing on the end walls 10*c* of the tray blank as it moves from the first magazine 26 into the second magazine 24. Thus, the tray blanks stored in the second magazine 24 will have been printed on two opposed end walls or flaps of the ultimate package prior to being convoyed by the conveyors 14 and 22 into the load station 16.

As mentioned previously conventionally located printheads 12, 12 can be utilized to print on the other two opposed side walls or flaps of the tray blank as the tray blank is conveyed in the general downstream direction defined by the packaging machine itself.

The printheads 30, 30 can be identical to the printheads 12, 12 but it is an important feature of the present invention that these printheads be readily removable and replaceable by other printheads in the event that product of different types and variety are to be packaged in the same machine. The capability of printing on all four flaps or side walls of a typical tray affords the packer with an opportunity to advertise his product beyond that of prior art trays, unless the packer had the foresight to have trays preprinted prior to being stored in the magazine of a conventional packaging machine. The present invention provides a convenient method for using an additional magazine and associated printing and conveying devices all of which are mounted on the packaging machine's primary magazine. The invention is preferably carried out by operating a mechanism for stripping the lowermost blank from an auxiliary magazine and moving the blank past printing heads that "preprint" two ends of the tray blank to the extent required for conventional printing of the two sides of the tray blank in a conventional packaging machine.

DESCRIPTION OF ALTERNATIVE EMBODIMENT (FIG. 5)

Figure 5:
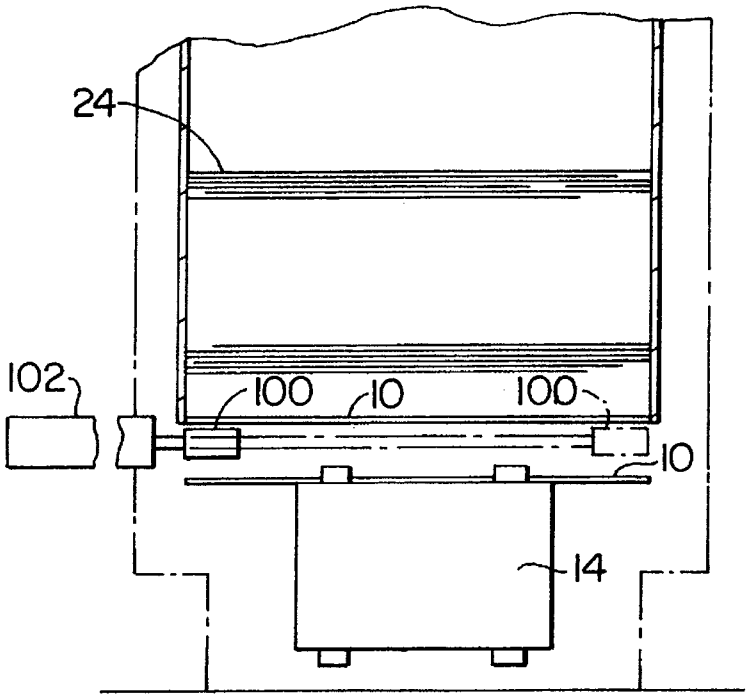
FIG. 5 shows schematically an alternative embodiment of the invention.

Another approach to printing tray blanks prior to loading the blank onto the tray conveyor is to provide a single magazine with the tray blank on the bottom or end of the stack printed by printed heads that themselves move in a direction transverse to that direction to be taken by the tray blanks in the machine. FIG. 5 shows such a movable printhead at 100. The actuator 102 achieves transverse movement thereof.

I claim:

1. A method for printing paper board tray blanks in a packaging machine for loading product on the tray blanks, said method comprising: providing a conveyor for moving tray blanks along a downstream direction, storing a plurality of tray blanks in a first magazine above and to one side of said conveyor, stripping the lowermost tray blank from the first magazine and moving it horizontally in a first direction oriented generally perpendicular to the downstream direction, providing a stationary printer in the path of the tray blanks moved in said first direction, printing the blank end walls during movement in said first direction, providing a second blank magazine above the conveyor for receiving the printed tray blanks as they move into the second blank magazine from said first direction, and stripping the lower most tray blank from said second magazine for movement downwardly into the path of said conveyor so that the imprinted tray blank moves through the packaging machine with the printed end walls on the forward and the trailing end flaps of the tray blank.

2. The method according to claim 1, wherein the tray blank sidewalls are printed as the tray blank moves downstream in said downstream direction.

* * * * *